US007665998B2

(12) United States Patent
Kressner et al.

(10) Patent No.: US 7,665,998 B2
(45) Date of Patent: Feb. 23, 2010

(54) RADIO FREQUENCY CONNECTOR

(75) Inventors: Kevin J. Kressner, Stowe, VT (US); Robert J. Delack, Waltham, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/362,700

(22) Filed: Jan. 30, 2009

(65) Prior Publication Data

US 2009/0197434 A1 Aug. 6, 2009

Related U.S. Application Data

(60) Provisional application No. 61/025,509, filed on Feb. 1, 2008.

(51) Int. Cl.
*H01R 9/00* (2006.01)

(52) U.S. Cl. ..... 439/63; 439/581; 439/579

(58) Field of Classification Search ..... 439/63, 439/581, 579

See application file for complete search history.

(56) References Cited

U.S. PATENT DOCUMENTS

| | | | |
|---|---|---|---|
| 5,405,267 | A | 4/1995 | Koegel et al. |
| 6,007,347 | A | 12/1999 | Keldsen et al. |
| 6,468,089 | B1 | 10/2002 | Hubbard et al. |
| 6,682,354 | B2 | 1/2004 | Carson et al. |
| 6,929,482 | B2 | 8/2005 | Benham |
| 6,965,279 | B2 | 11/2005 | Carson |
| 7,042,318 | B2 | 5/2006 | Barnes et al. |
| 7,048,547 | B2 | 5/2006 | Gottwald |
| 7,234,967 | B2 * | 6/2007 | Weidner et al. ..... 439/581 |
| 2002/0115314 | A1 | 8/2002 | Carson et al. |
| 2002/0177332 | A1 * | 11/2002 | Hubbard et al. ..... 439/63 |
| 2003/0186565 | A1 | 10/2003 | Kerekes et al. |
| 2004/0014350 | A1 | 1/2004 | McMullen et al. |
| 2004/0203289 | A1 | 10/2004 | Ice et al. |
| 2005/0215083 | A1 | 9/2005 | Kerekes et al. |
| 2005/0233610 | A1 | 10/2005 | Tutt et al. |

(Continued)

OTHER PUBLICATIONS

PCT Search Report of the ISA for PCT/US2009/032569 dated Aug. 6, 2009, 5 sheets.
PCT Written Opinion of the ISA for PCT/US2009/032569 dated Aug. 6, 2009, 5 sheets.

*Primary Examiner*—Gary F. Paumen
(74) *Attorney, Agent, or Firm*—Daly, Crowley, Mofford & Durkee, LLP

(57) ABSTRACT

An RF connector includes an RF connector block including a body portion having a plurality of dividers projecting from a surface thereof with each of the dividers having a first surface configured to mate with an RF circuit board and having a second sloped surface. The RF connector block also includes a plurality of signal contacts disposed between each of the plurality of dividers with a first portion of each of the plurality of signal contacts disposed to mate with the RF circuit board and a second portion of each of the signal contacts disposed through an opposite side of the RF connector block. A plurality of RF connector receptacles are configured to mate with the second portion of a corresponding one of said plurality of signal connectors. Such an arrangement results in an RF connector having signal contacts highly isolated from each other.

18 Claims, 11 Drawing Sheets

U.S. PATENT DOCUMENTS

2005/0250383 A1 11/2005 Bourgeas et al.
2006/0258180 A1 11/2006 Kerekes et al.
2006/0270279 A1 11/2006 Heisen et al.
2007/0077814 A1 4/2007 Sullivan et al.
2007/0111596 A1 5/2007 Weidner et al.
2007/0275605 A1 11/2007 Hubbard et al.

* cited by examiner

RADIO FREQUENCY CONNECTOR

CROSS REFERENCE TO RELATED APPLICATION

This application claims the benefit of U.S. Provisional Application No. 61/025,509 filed Feb. 1, 2008 under 35 U.S.C. §119(e) which application is hereby incorporated herein by reference in its entirety.

FIELD OF THE INVENTION

This invention relates to radio frequency (RF) connectors and more particularly to RF connectors having a relatively high isolation characteristic.

BACKGROUND OF THE INVENTION

As is known in the art, a radio frequency (RF) connector is an electrical connector designed to work at RF frequencies in the megahertz range and above. RF connectors are often used with coaxial cables. One desirable characteristic of an RF connector is its ability to maintain the shielding provided by a coaxial cable as well as the characteristic of reducing changes in transmission line impedance at the interface of the coaxial cable and the RF connector. Mechanically, RF connectors typically utilize a fastening mechanism (thread, bayonet, braces, push-pull) and springs to provide a low ohmic electric contact while sparing connector surfaces (which are often gold-plated). This allows above one-thousand reconnects and reduces the required insertion force.

As is also known, research activity in the area of RF circuit design has surged in the last decade in direct response to market demand for inexpensive, high data rate wireless transceivers. Such transceivers and other circuits utilize connectors so that signals can be coupled between various modules.

One type of RF connector is a so-called "edge-launch" connector. Edge launch connectors are provided having a housing through which a signal pin is disposed to contact a circuit on a printed wiring board (PWB). The PWB is often provided as part of a circuit card assembly (CCA), for example. RF signals propagate through the edge launch connector via the signal pin. As the name implies, edge launch connectors couple to an edge of the PWB (and thus, an edge of a CCA). One attractive feature of an edge launch connector is that owing to the manner in which such connectors are coupled to CCAs, edge launch connectors often introduce a relatively small insertion loss characteristic and a relatively low voltage standing wave ratio (VSWR) characteristic when connected to circuits on the CCA. One drawback with edge launch connectors, however, is that it is relatively difficult to provide a high degree of isolation between signal pins of multiple edge launch connectors mounted in proximity to each other on a CCA.

This is particularly true when isolation levels of about 100 dB are required between connectors mounted in proximity to each other on the same CCA. In one application, for example, an RF module requires over 100 dB of isolation from individual signals operating at similar microwave frequencies on a CCA. A common problem with conventional RF edge launch connectors is RF leakage which exists between the connector and the circuit card or between the connector and a circuit card cover due to connector geometry and practical limitations in holding mechanical tolerances during manufacturing operations. To improve the isolation characteristic of a conventional edge launch connector, an EMI gasket is sometimes disposed between the mating surfaces of the CCA and the connector disposed against the edge of the CCA. One problem with this gasket approach is that the gasket can become deformed (e.g. "bunch up") or can shear off completely resulting in gaps between the connector and CCA surfaces. This reduces the isolation characteristic of the connector.

It would, therefore, be desirable to provide an RF connector which can provide a high level of signal isolation between connector signal pins when several such signal pins are disposed in proximity on a CCA. It would also be desirable to provide an RF connector which can blindly mate to a circuit card since this provides for ease of circuit card insertion/extraction. It would also be desirable to provide an RF connector which can be mounted in close proximity with other connectors to accommodate tightly spaced signal paths necessitated by electrical and mechanical design constraints on a circuit. It would also be desirable to provide an edge launch RF connector which has one or more of the aforementioned characteristics.

SUMMARY OF THE INVENTION

In accordance with the concepts and structures described herein, an edge launch RF connector assembly adapted to couple to a printed wiring board (PWB) of a circuit card assembly (CCA) includes an RF connector block having a plurality of dividers projecting from a surface of the connector block, an EMI gasket configured to interface with the dividers of the RF connector block and the circuit card and a cover adapted to be disposed over the sloped surface of the RF connector block and a plurality of signal contacts with at least one divider disposed between each signal contact.

With this particular arrangement, an edge launch RF connector assembly having a high degree of isolation between signal contacts is provided. In one particular embodiment, the RF connector block includes a body portion having a slot provided therein to accept an edge of the PWB to which the RF connector block be will coupled and the dividers projecting from the body portion and having a sloped surface. The plurality of signal contacts also project from a first surface of the body portion and a plurality of ground tabs project from the first surface of the body portion proximate the signal contacts with the plurality of ground tabs adapted to couple a ground plane of the PWB to the RF connector block.

In one particular embodiment, the sloped dividers have one surface having a twenty-five degree sloping geometry (with the angle being measured relative to and from a PWB surface which contacts the divider). This allows the RF gasket to be provided as one continuous RF gasket to be disposed between the RF connector block and the cover with no gaps therebetween. In this manner, the signal contacts in the RF connector block are isolated from each other and are also isolated from noise outside the RF module to which the connector assembly is coupled. Thus, the edge launch RF connector assembly isolates each individual signal from each other and from extraneous RF signals external to the PWB (e.g. RF noise signals). Furthermore, each divider in the assembly includes an insert disposed between each signal contact. The insert allows the circuit card ground plane to be securely mated to the connector. Providing a secure connection between grounded portions of the connector and the RFP WB ground plane can improve the connector isolation characteristic as well as other connector performance characteristics such as insertion loss and impedance matching characteristics.

In one embodiment, there are two ground tabs on both sides of each signal pin. The ground tabs are coupled to a ground plane of the PWB to further improve the signal integrity and maintain a relatively high degree of isolation between signal contacts. By tightly grouping a plurality of signal contacts into one connector body, this approach also reduces the amount of circuit card space needed for RF connections. In one embodiment, two such edge launch RF connector assemblies, each containing seven edge launch connectors, fit on the edge of a standard 6U VME CCA, thereby allowing fourteen isolated RF signals to enter and exit the CCA.

The "dividers" are also sometimes referred to herein as "fingers" or "signal isolators." The angle (or slope) of one divider surface is selected to match the angle of the PWB on which it is disposed. A second surface of the divider is sloped. In one embodiment, the angle (or slope) of the second divider surface can range from about 10 to about 40 degrees as measured relative to and taken from a PWB surface upon which a connector signal contact is disposed. Factors to consider in selecting a specific angle for the sloped divider surface include, but are not limited to the particular type of material from which a gasket (e.g. an EMI gasket) disposed over the dividers is provided as well as the frequency range over which the connectors must operate. In one embodiment, twenty-five degrees is preferred. The smaller the angle chosen for the sloped surface, then the longer the divider which leaves less room for components on the PWB. If a larger angle is used, however, the divider becomes shorter using less component space, but there is an increase in the risk of shearing or bunching a gasket disposed over the sloped surface of the divider. A tear or other imperfection or bunching of the gasket would lead to a significant decrease in isolation between signal contacts. Thus, the designer needs to choose the angle that best fits the amount of PWB space available and matches the gasket material used. The dividers may be provided having a truncated-right triangle cross-sectional shape (in a cross-section taken along a central-longitudinal axis of the divider). It should be appreciated, of course, that other shapes may also be used including but not limited to: curved shapes; irregular shapes or regular shapes generally composed, in whole or in part, of straight line segments; and irregular shapes or regular shapes generally composed, in whole or in part, of arc segments.

In accordance with a further aspect of the concepts described herein, an RF connector block includes a body portion having a slot provided therein to accept an edge of a PWB to which the RF connector block will coupled, a plurality of sloped dividers projecting from a surface of the body portion, a plurality of signal contacts projecting a first surface of the body portion and a plurality of ground tabs projecting from the first surface of the body portion proximate the signal contacts wherein the plurality of ground tabs are adapted to couple a ground plane of the PWB to which the RF connector block will be coupled.

With this particular arrangement, an RF connector block, which provides a high level of RF isolation between signal paths on a CCA is provided. By providing the dividers having sloped surfaces (e.g. in the range of about twenty-five degrees to about forty-five degrees with respect to the PWB surface), a continuous bead of EMI gasket can be placed on a CCA cover and will not shear off when the cover is disposed over the gasket and is sealed to the connector block surface. Furthermore, the connector block can be provided with guide pins to ensure proper alignment of signal contacts to signal paths on a PWB to thereby reduce signal loss. When the connector block is provided a having a groove therein (via milling or some other technique), the edge of a circuit card can seat into the grove thereby improving isolation between the top and bottom surfaces of the card. In other embodiments, the PWB or CCA may be provided having a slot, groove, or other feature which mates with a corresponding feature on the connector block or some other portion of the connector assembly. By providing the connector with threaded inserts between each signal contact, a screw or other fastener is allowed to come through the bottom of the circuit and securely fasten the connector block onto a ground plane of the card which improves isolation between signal contacts (e.g. pin-to-pin isolation). Furthermore, by providing the ground tabs as solderable ground tabs in close proximity to both sides of each signal contact, the connector block provides improved grounding and impedance matching (e.g. VSWR characteristics) to RF connectors coupled to the connector block.

BRIEF DESCRIPTION OF THE DRAWINGS

The foregoing features of this invention, as well as the invention itself, may be more fully understood from the following description of the drawings in which.

DETAILED DESCRIPTION OF THE PREFERRED EMBODIMENTS

Figure 1:
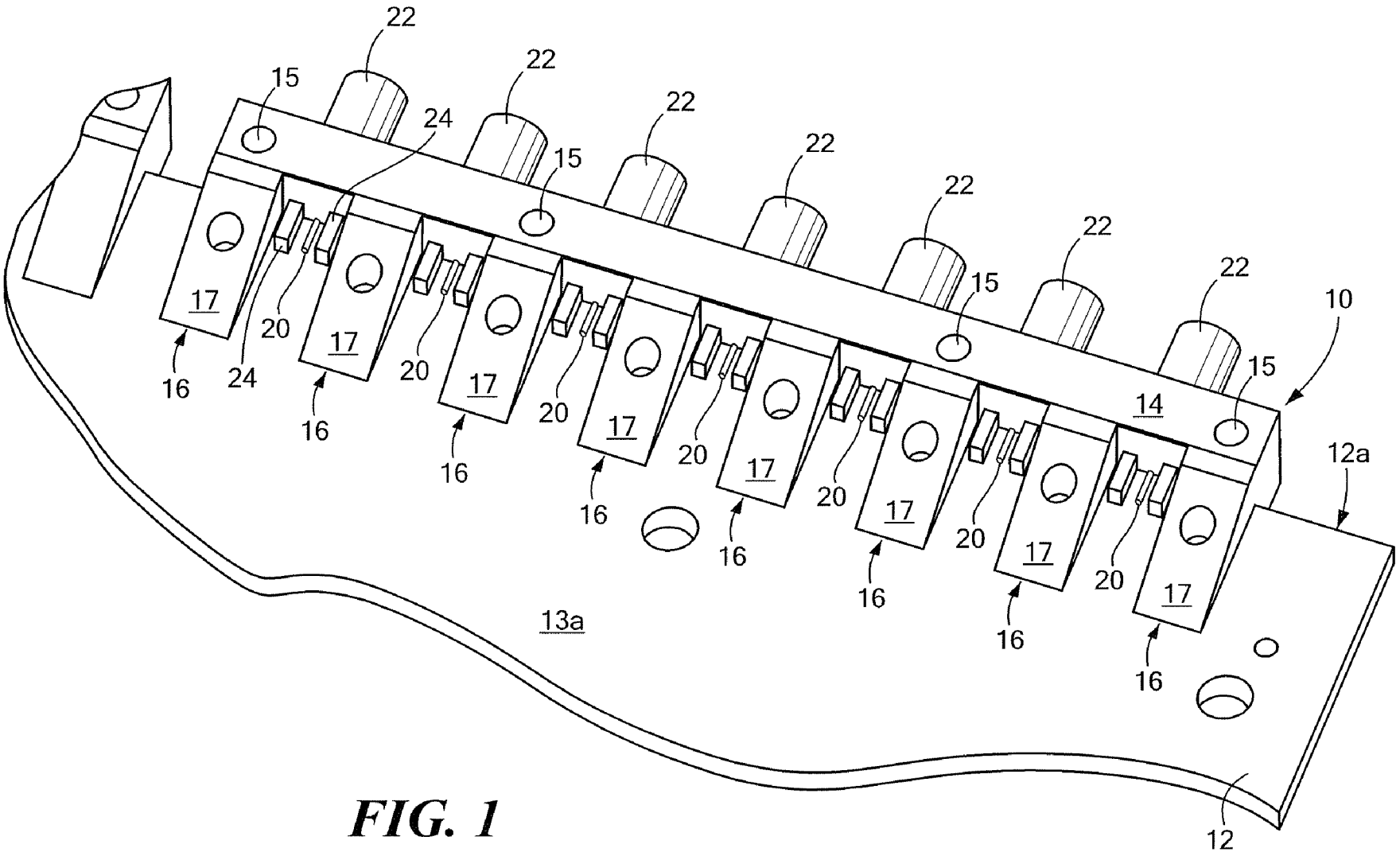
FIG. 1 is an isometric top view of a portion of a radio frequency (RF) connector block coupled to an RF.

Referring now to FIGS. 1-4A in which like elements are provided having like reference designations throughout the several views, an edge launch radio frequency (RF) connector block 10 is coupled to an edge 12*a* of a printed wiring board (PWB) 12 having first and second opposing surfaces 13*a*, 13*b*. The RF connector block 10 includes a body portion 14 having a plurality of threaded holes 15 provided therein. In one embodiment, holes 15 are provided from threaded #2 inserts. As is known, a "threaded insert" is a piece of hardware which would be inserted into hole 15 to make it a threaded hole instead of a thru hole. This is done instead of mechanically threading hole 15. As will become apparent from the description hereinbelow in conjunction with FIG. 7, threaded inserts 15 are used to secure an RF cover to the RF connector which improves isolation between different RF signals.

A plurality of dividers 16 project from a surface of body portion 14. The dividers 16 have a first or lower surface disposed on a first or top surface 13*a* of the PWB 12 and a second or upper sloped surface 17. An optional hole 42 is provided in dividers 16. In one embodiment, and for reasons which will become apparent from the description herein below, hole 42 is provided as a threaded hole which accepts a screw which secures the connector to PWB 12. In one embodiment, stainless steel threaded inserts are disposed in openings provided the connector block. Thus, in the event that screws 40 used to attach a connector to a circuit card are provided from a relatively hard material (e.g. steel or stainless steel) and the connector block is provided from a material which is softer than the screw material (e.g. aluminum is softer than stainless steel), then the screws 40 will not damage softer connector block material.

Figure 2:
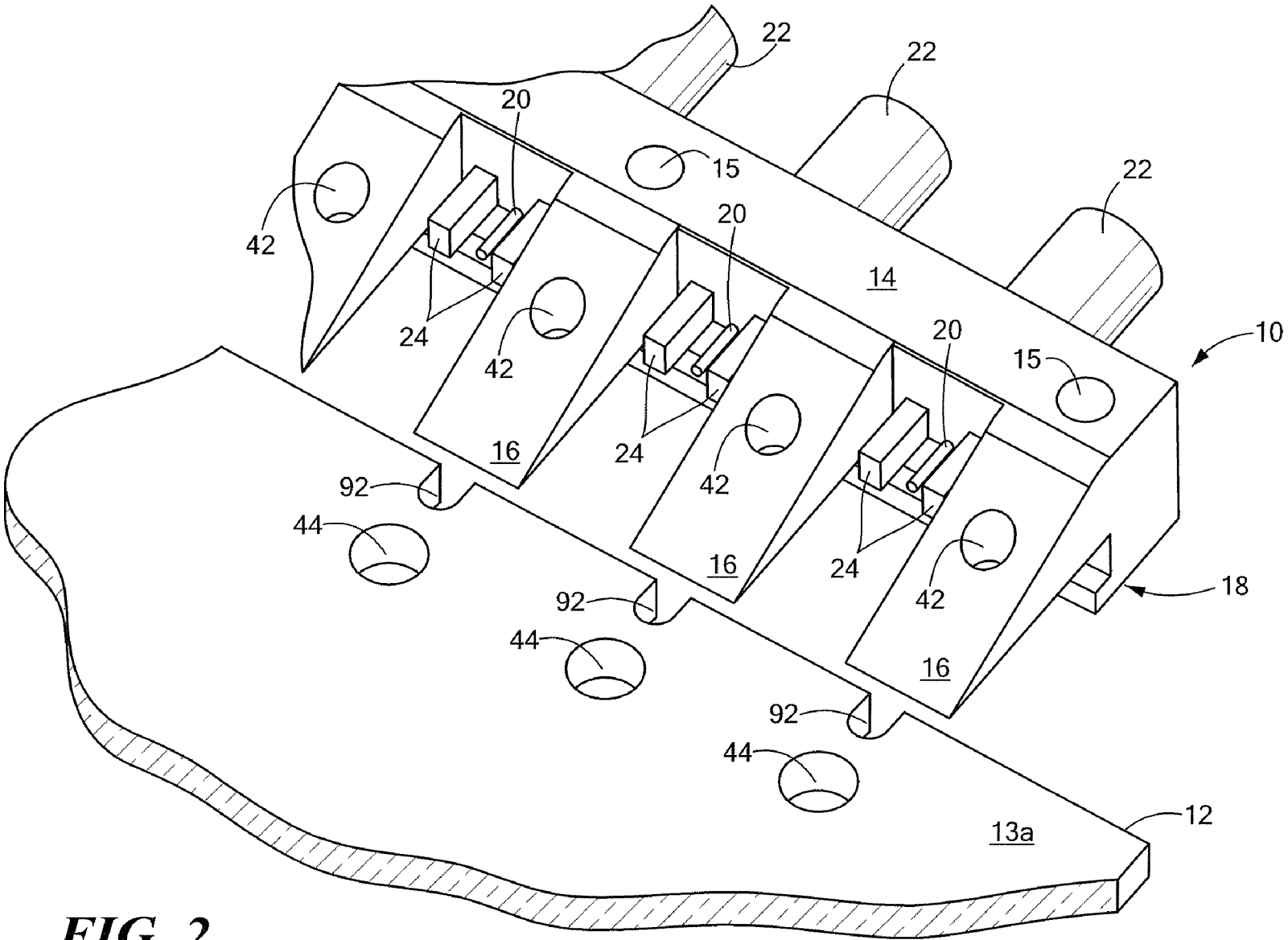
FIG. 2 is an exploded isometric top view of a portion of an RF connector block and an RF printed wiring board (PWB)
Figure 3:
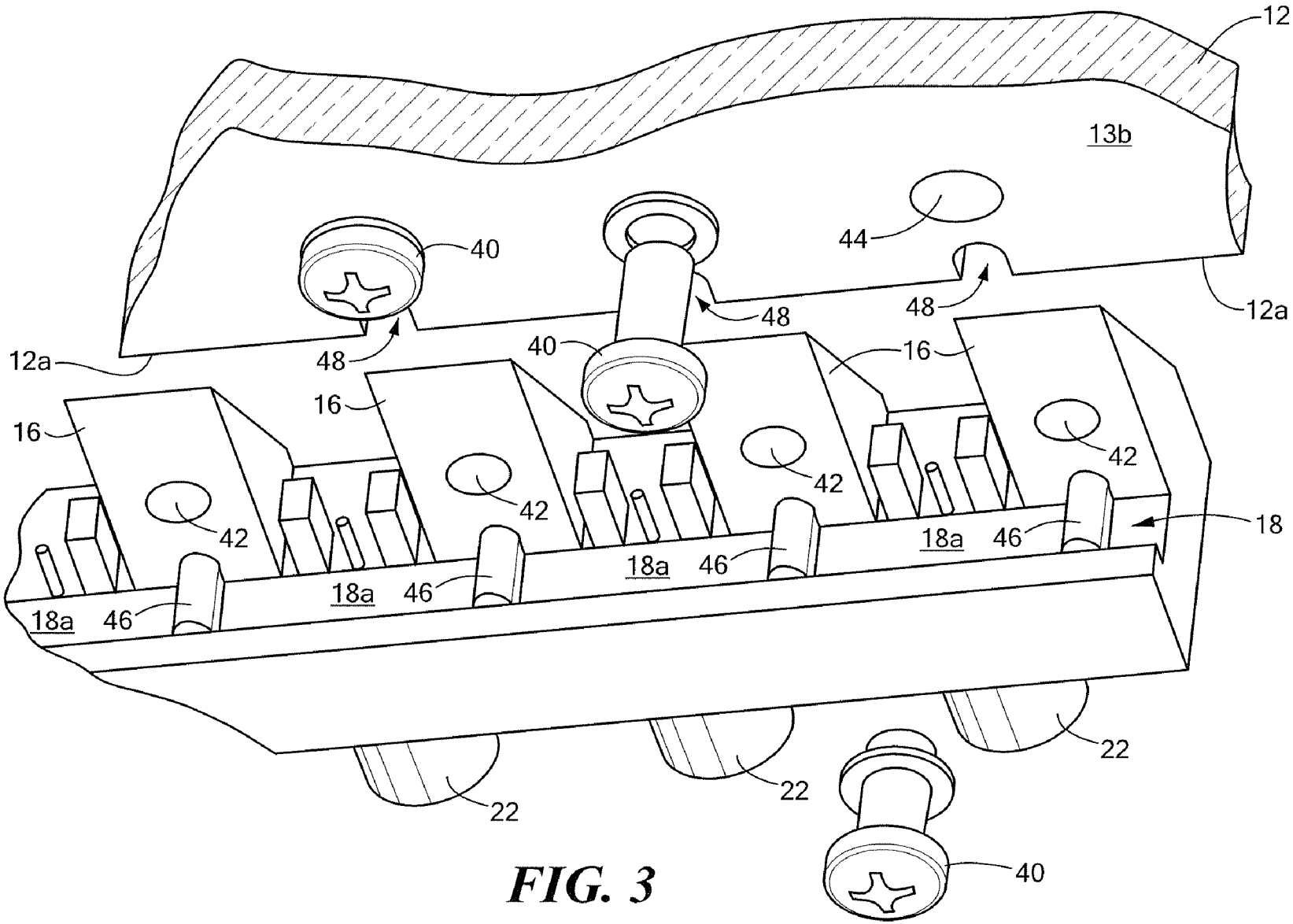
FIG. 3 is an exploded isometric bottom view of an RF connector block and an RF PWB.

As can be most clearly seen in FIGS. 2 and 3, the body portion 14 has an opening 18, (such as a slot, a channel, or a groove) provided therein. Opening 18 is provided having a shape which can accept at least a portion of PWB 12 such as edge 12*a* of the PWB 12. Also projecting from a surface of body portion 14 of connector block 10 are a plurality of signal contacts 20 (e.g. pins, tabs or the like) as well as ground contacts 24. On the PWB side, the signal contacts lead to signal paths 21 on the PWB. Signal paths 21 may be implemented as any type of RF transmission line including but not limited to any type of printed circuit transmission line including but not limited to stripline, microstrip, and co-planar waveguide.

It should be appreciated that slight modifications may need to be made in connector 10 depending upon the manner in which the signal paths are implemented. It should also be understood that such changes are within the level of skill of one of ordinary skill in the art and that such changes do not depart from the concepts described herein which relate to an RF connector which provides a high RF isolation characteristic between proximately disposed signal contacts.

Figure 4:
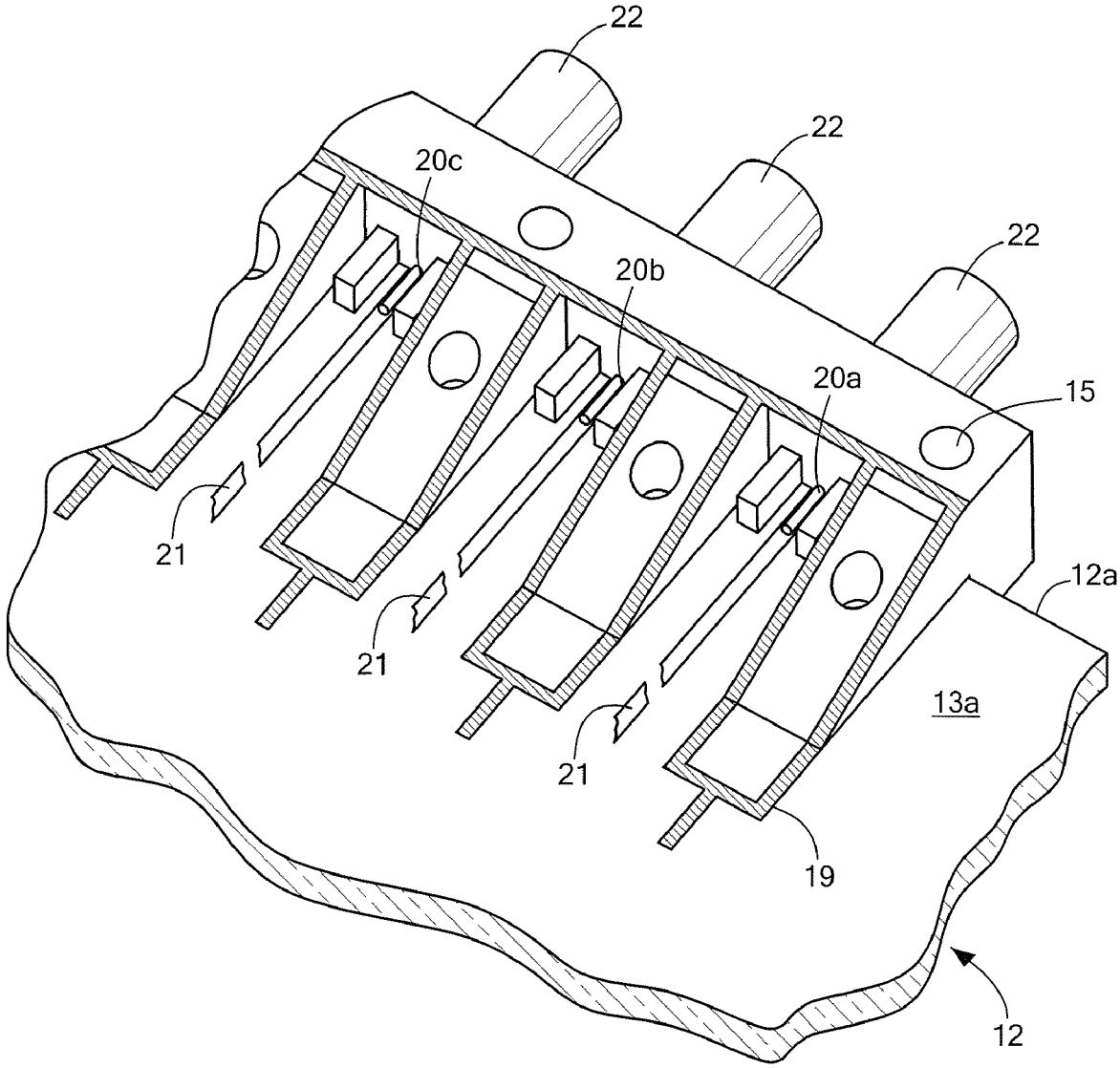
FIG. 4 is an isometric top view of a portion of an RF connector block assembled on an RF PWB.

To promote clarity in the drawings, signal paths 21 have been omitted from drawing FIG. 2, but can be clearly seen in FIG. 4. The other end of signal contacts 20 (i.e. the portions of signal contacts 20 which are not visible in FIGS. 1-4) lead to a connector mating structure 22. Also projecting from a surface of the body portion 14 are a plurality of ground tabs 24, which are coupled to a ground plane of the PWB. In one embodiment, a pair of ground tabs are provided on each side of every signal contact 20.

Figure 4A:
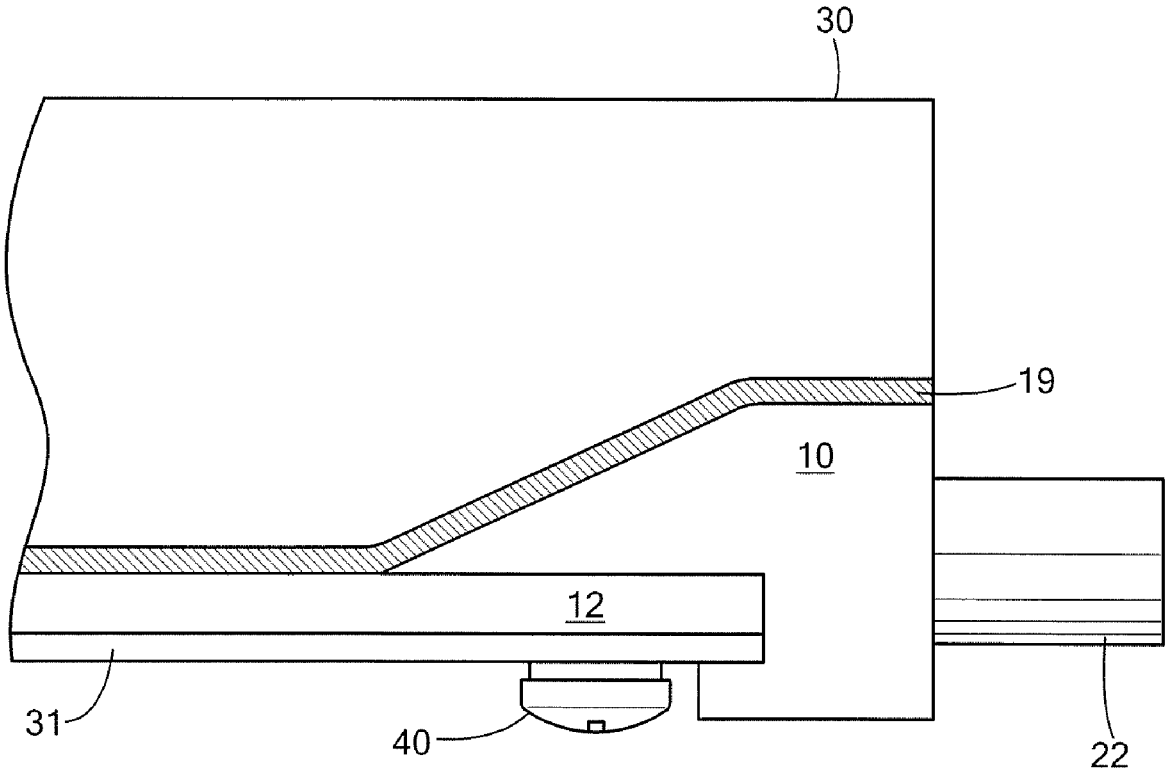
FIG. 4A is a side view of an RF connector block and top RF cover assembled on an RF PWB.

As may be most clearly seen in FIGS. 4 and 4A, on the PWB side of the connector block, the signal contact 20 are coupled to respective ones of signal paths 21 on the PWB (signal paths 21 being omitted from FIG. 1 to improve the clarity of the figure) and the ground tabs 24 are coupled to the ground plane of the PWB. Each of the signal contacts are adapted to couple RF signals through the connector block and to an RF connector coupled to the opposite side of the connector block 14.

In one embodiment, the ground tabs are milled into body portion 14 of the connector block 10. Thus, in this embodiment, the connector block and ground tabs are provided from a monolithic block. Also, in one embodiment, the ground tabs are coupled to the ground plane of the PWB by soldering the ground tabs to the ground plane. Techniques other than soldering may, of course, also be used to couple the ground tabs to the PWB ground plane. It should, of course, also be appreciated that in other embodiments, it may be preferable, desirable or even necessary to provide the ground tabs as a part which is separate from the body portion (or some other portion) of the connector block in which case the ground tabs would be secured to the connector block by an appropriate technique (e.g. by boring one or more holes into a portion of the connector block and press fitting the ground tabs into the one or more holes or by otherwise securing the ground tabs to the connector block via fasteners, epoxy, glue or via some other technique).

As may also be most clearly seen in FIGS. 4 and 4A, an RF gasket 19 is disposed over the sloped dividers 16 to help provide the RF connector block having a relatively high isolation characteristic between RF signals propagation on each of the signal contacts 20. Thus, for example, RF signals propagating on a first signal contact 20*a* are highly isolated from RF signals propagating on signal contacts 20*b*, 20*c*. In one embodiment, RF gasket 19 may be provided as a continuous EMI gasket which increases signal isolation between signal contacts 20. Also, in one embodiment, 110 db of isolation is provided between signal contacts. It should, of course, be appreciated that the specific amount of isolation achieved in any particular embodiment is highly dependent upon the type of RF connector used within connector block 10 as well as the operational frequency range of the connector.

Referring now to FIG. 4A, a top RF cover 30 is secured to connector block 10 via screws (not shown in FIG. 4A) which pass through cover 30 and mate with openings 15 in the RF connector block. A bottom cover 31 is secured to PWB 12 and connector block 10 via screws 40 (only one of which is visible in FIG. 4A) which mates with a threaded hole provided in RF connector block 10 (e.g. threaded hole 42 in FIG. 3).

It should be noted that EMI gasket 19 is disposed over sloped surface 17. It should be appreciated that surface 17 is provided having a gradual slope selected to reduce shear force that could tear or bunch the EMI gasket 19.

In one embodiment, opening or slot 18 in connector block can accept any PWB edge having a thickness less than 0.112 inches and the angle of the slope on the sloped dividers 16 can range from about 10 to about 40 degrees as measured from PWB surface 13*a* with a slope of about 25 degrees being preferred. The particular angle of the sloped divider surface to use in any particular application is selected in accordance with a variety of factors including, but not limited to, the type of material from which the gasket 19 is provided and the amount of available space on the PWB. The smaller the angle chosen, the longer the divider which leaves less room for components on the PWB. The larger the angle used, the shorter the length of the divider thereby using less space on the PWB (which leaves more space on the PWB, e.g. for mounting circuit components), but the risk of shearing or bunching the gasket 19 on top of the divider 16 increases. If the gasket shears or bunches, this would likely lead to a decrease (possibly a significant decrease) in the RF isolation characteristic between RF signals propagating on adjacent or even proximate signal paths and/or signal contacts. Thus, an angle that best fits the amount of PWB space available and matches the gasket material should be used. It should be appreciated that the slope of surface 17 has a relationship to the shear force exerted with cover 30 disposed over gasket 17 and that such sheer force could tear or bunch the gasket 19. In particular, the more shallow the slope of surface 17, the lower the shear force.

As shown in FIG. 4A, a top cover 30 is disposed over the connector block 10 and the RF PWB 12 to further improve the isolation characteristic between the signal pins 20. By sealing the RF cover 30 to the RF PWB 12, a high level of RF isolation between signal contacts coupled to the PWB 12 is provided.

Referring now to FIG. 2, in one embodiment PWB 12 is provided having one or more slots therein. In some embodiments, slot(s) 92 may be provided as a plated slot(s) 92 (also visible in FIG. 8). Slots 92 accept a corresponding tab 46 (FIG. 3) projecting from a surface of the RF connector block 18. In the embodiment shown in FIG. 3, tabs 46 project from a surface of channel 18. The slots 92 and mating tabs 46 cooperate to align the connector 10 and PWB 12 in desired relative positions.

The PWB 12 also has a plurality of through holes 44 provided therein. Through holes 44 accept connector mounting screws 40 (FIG. 3) which are disposed through openings 42 (FIG. 3) in dividers 16. The screws 40 secure the PWB 12 to the RF connector 10. In the embodiment shown herein, screws 44 are located on both sides of signal contacts 20 (and hence on both sides of an RF signal path leading to contacts 20) which improves RF isolation between RF signals propagating along the multiple signal paths to the respective signal contacts 20. In one embodiment, openings 42 are provided as threaded openings sized to accept a #2 size screw 40 which is used to secure the connector 10 to the PWB 12 The fastener 40 travels through bottom cover 31, board hole 44, then into connector hole 42. In some embodiments a lock-washer may be used on surface 13*b* to keep the fastener from pulling out.

In one embodiment, the ground tabs 24 are soldered to a surface 12*a* of PWB 12. This improves isolation between RF signals propagating through signal contacts 20. The signal contacts are soldered to the signal paths 21 (FIG. 4) on PWB 12.

In the embodiment described herein, the PWB solder layout is provided in a manner which matches industry standard SMP edge mount connectors. It should, however, be appreciated that other configurations may also be used to match other industry standard connectors or configurations may be used to match any type of standard or non-standard connectors. Thus, connector 10 may be configured for use in a wide variety of applications requiring a large number of different connector types including, but not limited to SMA, SSMA, ETC. SMB, SSMB and SMP connector types.

Connector block surface 14 also has provided therein a plurality of holes 15. In one embodiment, holes 15 may be provided as threaded #2 inserts which are configured to secure an RF cover (e.g. RF cover 30 in FIG. 4A) to the RF connector block 10 which improves isolation between different RF signals propagating on PWB 12.

As shown in FIG. 3, screws 40 are disposed in holes 42 in the dividers 16 and through holes 44 in the PWB. The screws secure the PWB to the RF connector block, while at the same time improving the RF isolation between the signal contacts. The opening 18 has tabs 46 projecting therefrom, which mate with corresponding openings 48 in the PWB.

By providing the connector assembly having the mounting tabs and screws, the RF connector block 10 is adapted to blindly mate to a circuit card assembly (CCA) having corresponding mating structures (e.g. openings 44, 48).

In one embodiment, screws 40 are provided as #2 Phillips-head screws which are disposed through openings in both bottom cover 31 (FIG. 4A) and RFPWB 12 in divider 16. Those of ordinary skill in the art will, of course, understand how to select the size (e.g. diameter, length, thread pitch, etc. . . . ) of screws 40 for particular applications. It should be understood that the size of screws 40 and openings 42, 44 are selected to cooperate with each other.

As noted above, an edge of PWB 12*a* fits into groove 18 on connector 10. In some embodiments, groove 18 can be soldered or sealed into the PWB to improve isolation. This solder connection in groove 18 is made between the surface of PWB edge 12*a* and surface 18*a* of groove 18. In one embodiment, PWB slots 48 are plated and are soldered to isolation tabs 46 on connector 10.

Figure 5:
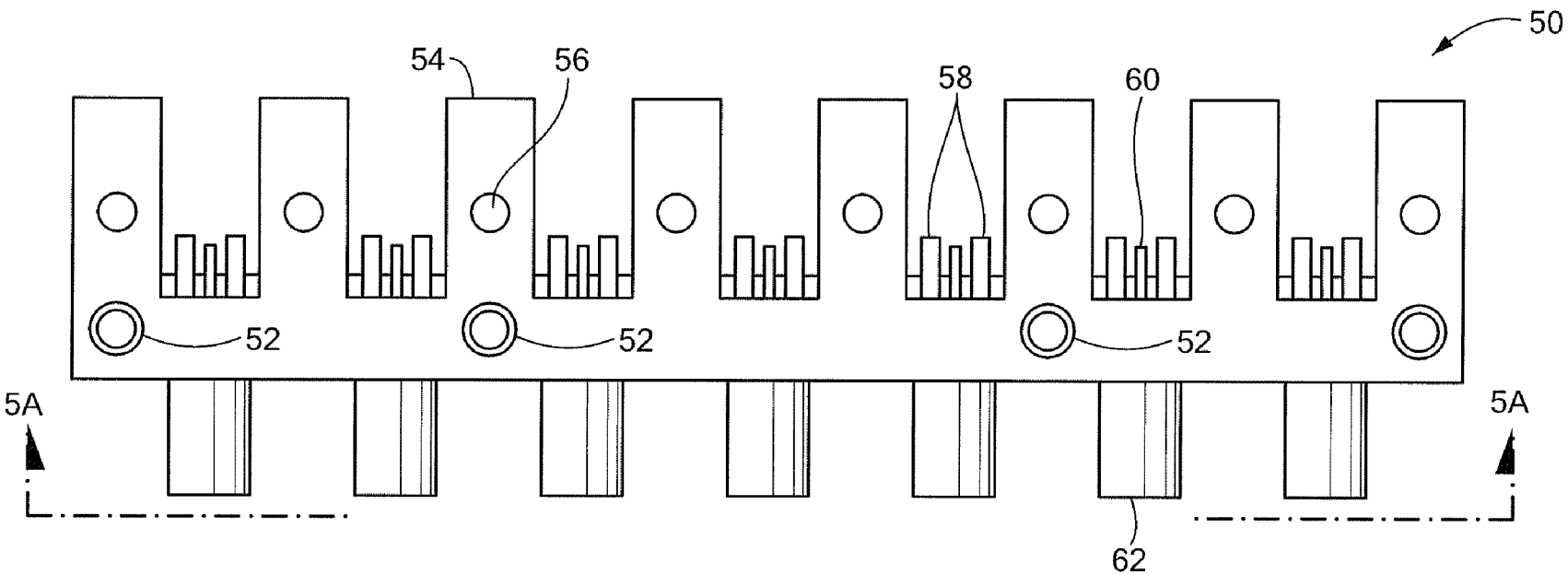
FIG. 5 is a top view of an RF connector block.
Figure 5A:
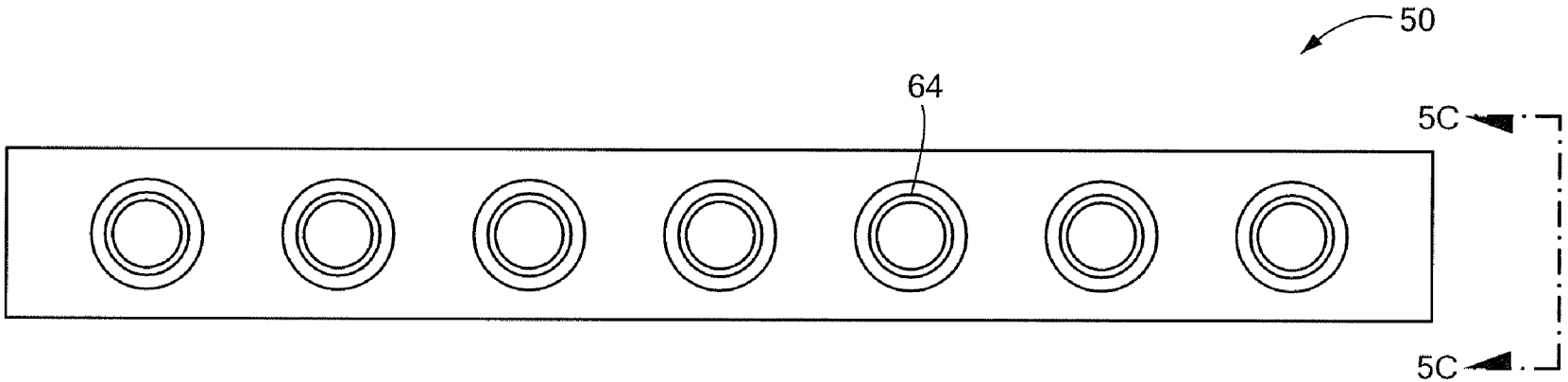
FIG. 5A is a front view of an RF connector block.
Figure 5B:
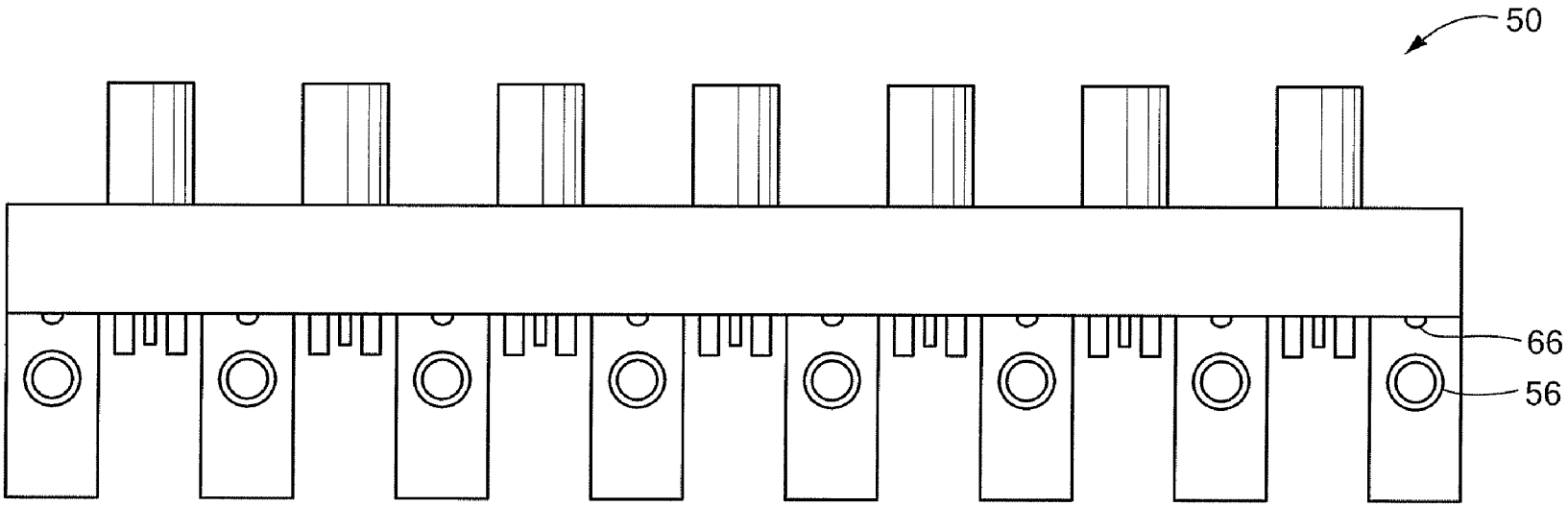
FIG. 5B is a bottom view of an RF connector block.
Figure 5C:
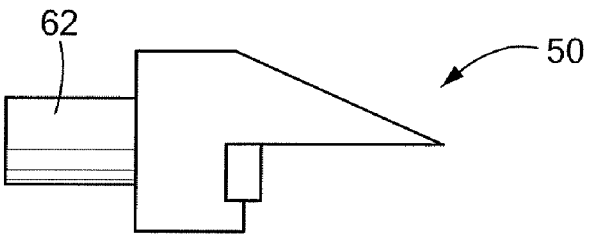
FIG. 5C is a side view of an RF connector block.

Referring now to FIGS. 5-5C in which like elements are provided having like reference designations throughout the several views, an RF connector block 50 able to accept seven RF connectors are shown. It should be appreciated that although seven connectors are shown, the connector block may, of course, be provided having fewer or greater than seven connectors.

With seven connectors, the connector block 50 may be secured to a PWB with four screws, disposed through openings 52 arranged approximately as shown The particular number of screws to use in any application is selected to help provide a desired amount of isolation between signal contacts. Also, the connector block may be secured to the PWB via a solder technique or any other technique known to those of ordinary skill in the art.

Figure 6:
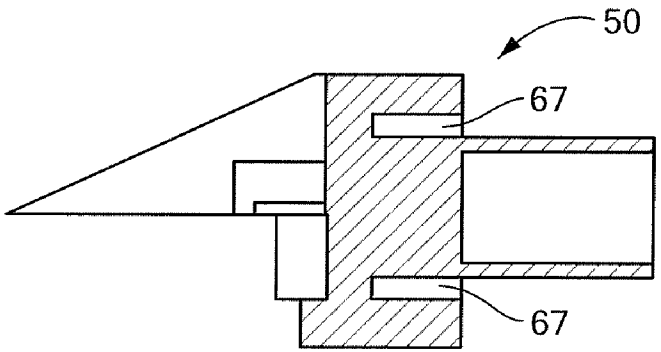
FIG. 6 is a side sectional view of an RF connector block.

Referring now to FIG. 6, a partial side-sectional view of RF connector block 150 reveals openings 67, which may be used to mount an RF connector (not shown) or an RF backplane (not shown) to the connector block.

Figure 7:
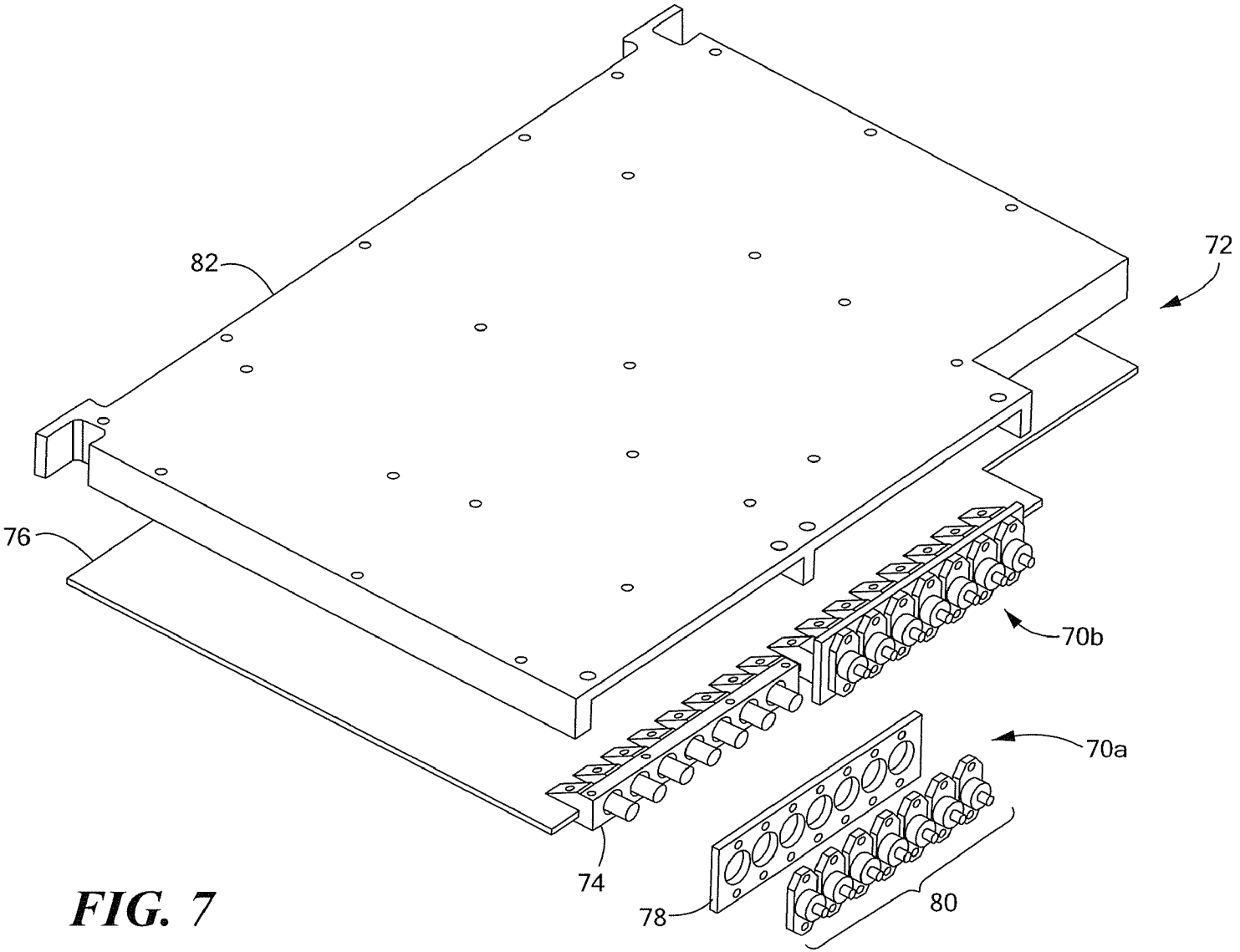
FIG. 7 is an exploded isometric view of an RF connector block assembled into an RF CCA module.
Figure 7A:
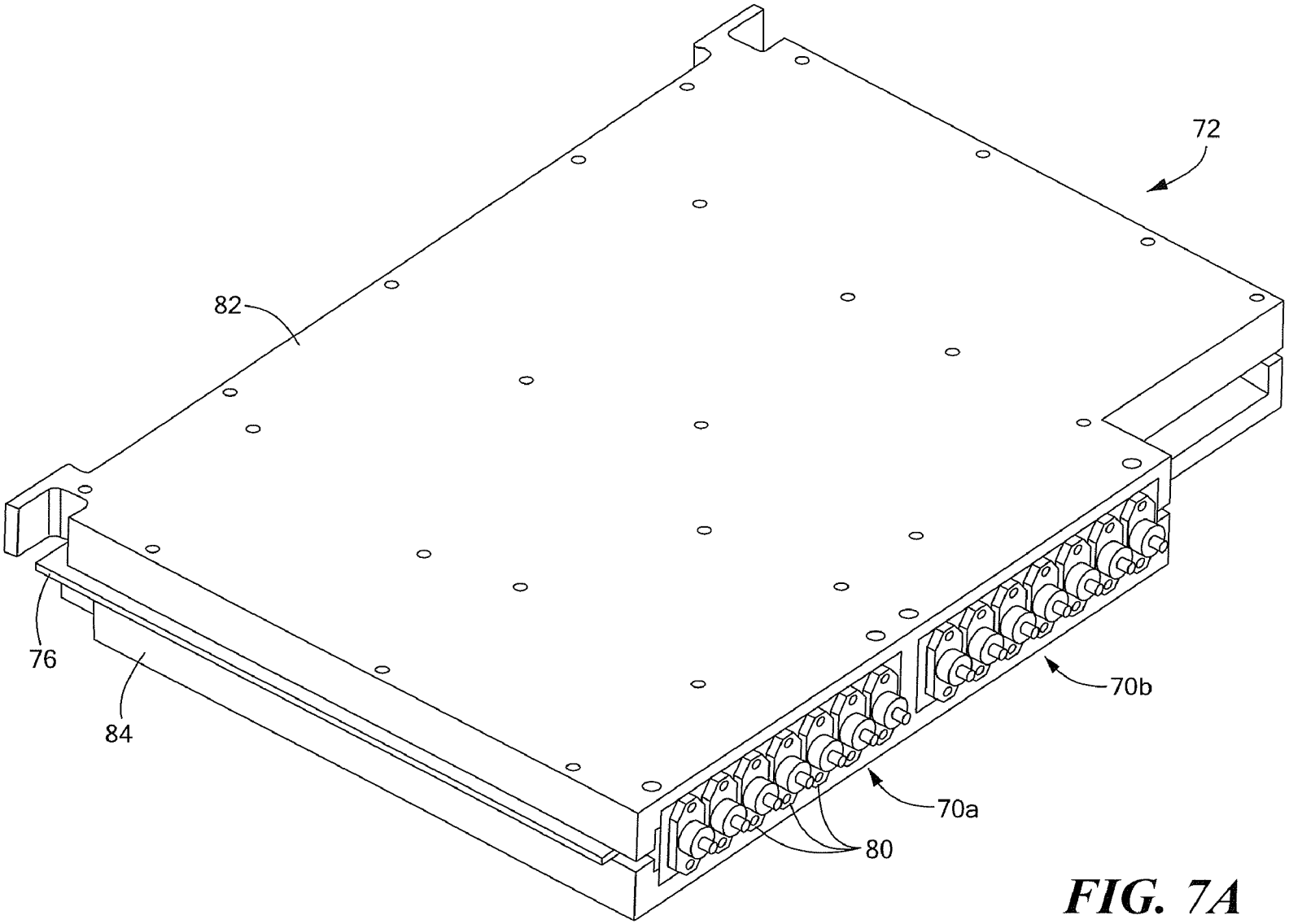
FIG. 7A is an isometric view of an RF connector block assembled into an RF CCA module.

Referring now to FIGS. 7 and 7A, in which like elements are provided having like reference designations throughout the several views, a pair of RF connector assemblies 70*a*, 70*b* are coupled to a circuit card assembly (CCA} module 72 provided from an RF CCA 76 and an RF CCA cover 82. Each RF connector assembly 70*a*, 70*b* includes an RF connector block 74 coupled to an RF CCA 76, an RF connector backplane 78 which serves to secure and align the connectors 80 which couple to the connector block 74, a plurality of RF connector receptacles 80 coupled to the RF connector block through the backplane and a cover 82. In this particular embodiment, the cover 82 serves as both a cover for the RF connector block as well as a top cover for the RF CCA. In some embodiments, the cover for the RF connector assembly may be provided having a size and shape which covers the RF connector block. In this case, CCA module would be provided having a top and a bottom cover 84. It should be appreciated that the decision to use a cover in a particular application depends upon the application and it not necessarily related to the connector or improving isolation between connector contacts.

Figure 8:
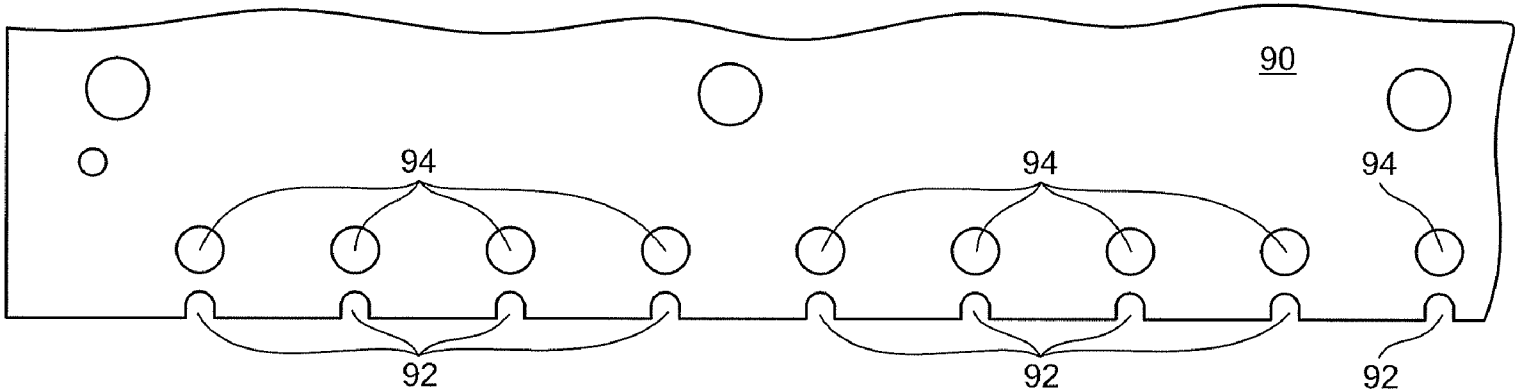
FIG. 8 is a top view of an RF PWB having cut-outs made therein to accept an RF connector block.
Figure 8A:
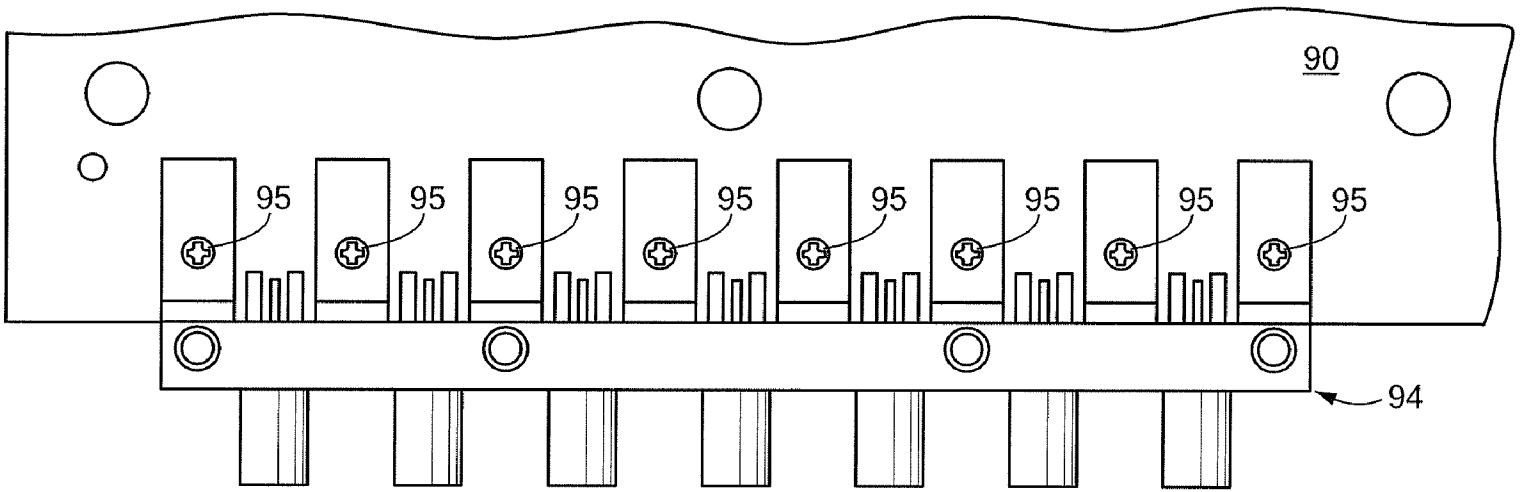
FIG. 8A is a top view of an RF connector block assembled to an RF PWB.
Figure 8B:
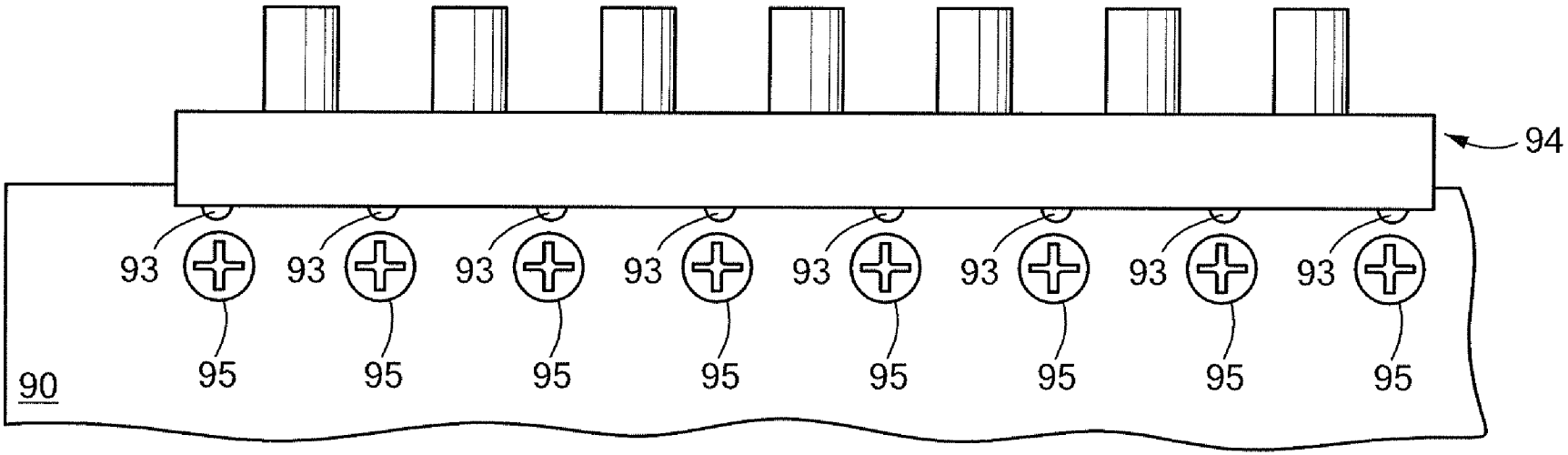
FIG. 8B is a bottom view of an RF connector block assembled to an RF PWB.

Referring now to FIGS. 8-8B in which like elements are provided having like reference designations throughout the several views, a PWB 90 has a first plurality of cut-outs 92 provided in an edge thereof. The cut-outs 92 are provided to accept a like plurality of tabs 93 (which may be the same as or similar to tabs 46 in FIG. 3) provided on the RF connector block. With this technique, the RF connector block can be properly aligned on the PWB 90. This also allows blind mating of the RF connector block to the PWB. The PWB also includes holes 94, which accept mounting screws 95 (which may be the same as or similar to screw 40 shown in FIG. 3).

Furthermore the connector assembly described herein includes guide pins to ensure proper signal alignment and reduce loss; this connector has a groove milled into it that allows the edge of the circuit card to seal into improving isolation from the topside of the card to the bottom; this connector has threaded inserts between each signal to allow a screw to come through the bottom of the circuit and securely fasten the connector into the cards top ground plane, improving pin-to-pin isolation; and for additional grounding and improved VSWR, solderable ground tabs have been added very closely to both sides of each signal pin.

What is claimed is:

1. An edge launch RF connector assembly for mating to a printed wiring board (PWB), the edge launch RF connector comprising:

(a) an RF connector block including a body portion having a slot provided therein to accept an edge of the PWB to which the RF connector block will coupled;

a plurality of dividers projecting from a surface of the body portion, each of the dividers having a first surface adapted to mate to a surface of said PWB and a second, sloped surface;

a plurality of signal contacts projecting from a first surface of the body portion;

a plurality of ground tabs projecting from the first surface of the body portion proximate the signal contacts, said plurality of ground tabs adapted to couple a ground plane of the PWB to the RF connector block;

(b) an RF gasket disposed over the sloped surface of each of the dividers;

(c) a plurality of RF connector receptacles coupled to the connector block with each of said RF connector receptacles electrically coupled to a corresponding one of said plurality of signal contacts; and (d) an RF cover disposed over said RF connector block.

2. The edge launch RF connector assembly of claim 1 further comprising an RF connector backplane, coupled between said RF connector block and said plurality of RF connector receptacles.

3. The edge launch RF connector assembly of claim 1 wherein said RF gasket is provided as an EMI gasket adapted to interface with the sloped surface of the RF connector block.

4. The edge launch RF connector assembly of claim 1 wherein the sloped surface of each of said dividers has a slope in the range of about 5 degrees to about 45 degrees as measured from the surface of the PWB.

5. The edge launch RF connector assembly of claim 1 wherein the slope of the surface of said RF connector block is provided is about twenty-five degrees.

6. The edge launch RF connector assembly of claim 1 wherein said plurality of edge launch connectors correspond to SMP edge launch connectors.

7. The edge launch RF connector assembly of claim 1 wherein said EMI gasket corresponds to one continuous EMI gasket adapted to interface directly to the sloped surface of the edge launch RF connector.

8. The edge launch RF connector assembly of claim 1 wherein the plurality of RF connector receptacles correspond to seven (7) RF connector receptacles each of which is adapted to couple to an SMP compatible edge launch connector.

9. The edge launch RF connector of claim 1 wherein each divider is provided having a hole therein through which an insert may be disposed to be securely mate the circuit card ground plane to the RF connector.

10. The edge launch RF connector of claim 1 wherein the ground tabs are provided as solderable ground tabs disposed on different sides of each signal pin.

11. The edge launch RF connector of claim 1 wherein each divider is provided having a hole therein through and further comprising:

a plurality of threaded inserts, each of the plurality of threaded inserts disposed in a corresponding one of the divider holes;

a screw adapted to come through a bottom surface of the PWB and securely fasten the RF connector into a top ground plane of the PWB thereby improving the isolation characteristic between the plurality of pins in said connector block.

12. An RF connector block comprising:

a body portion having a slot provided therein to accept an edge of the PWB to which the RF connector block will coupled;

a plurality of sloped dividers projecting from a surface of the body portion;

a plurality of signal contacts projecting a first surface of the body portion; and a plurality of ground tabs projecting from the first surface of the body portion proximate the signal contacts, said plurality of ground tabs adapted to couple a ground plane of the PWB to the RF connector block.

13. The RF connector block of claim 12 further comprising a plurality of RF connector receptacles coupled to said body portion of the RF connector block with each of said RF connector receptacles electrically coupled to a corresponding one of said plurality of signal contacts.

14. The edge launch RF connector assembly of claim 12 wherein the sloped surface of each of said dividers has a slope in the range of about 5 degrees to about 45 degrees as measured from a surface of the PWB.

15. The edge launch RF connector assembly of claim 12 wherein the slope of the surface of said RF connector block is about twenty-five degrees as measured from a surface of the PWB.

16. An RF connector comprising:

(a) an RF connector block including a body portion having a plurality of dividers projecting from a surface thereof with each of the dividers having a first surface configured to mate with an RF circuit board and having a second sloped surface and the RF connector block including a plurality of signal contacts disposed between each of said plurality of dividers with a first portion of each of said plurality of signal contacts disposed to mate with the RF circuit board and a second portion of each of the signal contacts disposed through an opposite side of said RF connector block;

(b) a plurality of RF connector receptacles configures to mate with the second portion of a corresponding one of said plurality of signal connectors; and (c) an RF connector backplane disposed between said RF connector block and said RF connector receptacles.

17. The RF connector of claim 16 wherein said signal contacts are provided as signal pins.

18. The RF connector of claim 16 wherein said RF connector block is configured to mate to an edge of an RF circuit board.

* * * * *

UNITED STATES PATENT AND TRADEMARK OFFICE

CERTIFICATE OF CORRECTION

PATENT NO. : 7,665,998 B2
APPLICATION NO. : 12/362700
DATED : February 23, 2010
INVENTOR(S) : Kevin J. Kressner et al.

It is certified that error appears in the above-identified patent and that said Letters Patent is hereby corrected as shown below:

Column 8, line 66 delete "will" and replace with --will be--;

Column 9, line 46 delete "be";

Column 10, line 8 after "will" insert --be--.

Signed and Sealed this

Twentieth Day of April, 2010

David J. Kappos

David J. Kappos
*Director of the United States Patent and Trademark Office*